US009697664B2

(12) United States Patent
Ribas et al.

(10) Patent No.: US 9,697,664 B2
(45) Date of Patent: Jul. 4, 2017

(54) ELECTRONIC LOCKING SYSTEMS, METHODS, AND APPARATUS

(71) Applicant: Digilock Asia Limited, Petaluma, CA (US)

(72) Inventors: Gabriel Bestard Ribas, San Francisco, CA (US); Steven Thomas Bakondi, San Francisco, CA (US); Lloyd Seliber, San Mateo, CA (US)

(73) Assignee: DIGILOCK ASIA LIMITED, Petaluma, CA (US)

( * ) Notice: Subject to any disclaimer, the term of this patent is extended or adjusted under 35 U.S.C. 154(b) by 0 days.

(21) Appl. No.: 14/742,590

(22) Filed: Jun. 17, 2015

(65) Prior Publication Data

US 2015/0287254 A1 Oct. 8, 2015

Related U.S. Application Data

(63) Continuation-in-part of application No. 13/889,241, filed on May 7, 2013, which is a continuation-in-part of application No. PCT/ES2013/070229, filed on Apr. 10, 2013.

(60) Provisional application No. 61/692,324, filed on Aug. 23, 2012.

(30) Foreign Application Priority Data

Apr. 11, 2012 (ES) ..... 201230535

(51) Int. Cl.
*G07C 9/00* (2006.01)

(52) U.S. Cl.
CPC ..... *G07C 9/00817* (2013.01); *G07C 9/00571* (2013.01); *G07C 2009/00825* (2013.01); *G07C 2009/00865* (2013.01); *G07C 2209/62* (2013.01)

(58) Field of Classification Search
CPC ..... G07C 9/00119; G07C 9/00817; G07C 9/00571; G07C 9/00896; G07C 9/00309; G08B 13/06; G08B 13/08; E05B 45/06; E05B 67/383; E05B 47/0004; E05B 5/003
USPC .... 340/542, 5.61, 545.6, 5.73; 70/14, 278.2; 292/1
See application file for complete search history.

(56) References Cited

U.S. PATENT DOCUMENTS

| | | | |
|---|---|---|---|
| 4,677,284 | A | 6/1987 | Genest |
| 5,668,876 | A | 9/1997 | Falk et al. |
| 6,084,532 | A | 7/2000 | Prieto et al. |
| 6,097,306 | A | 8/2000 | Leon et al. |
| 6,900,720 | B2 | 5/2005 | Denison et al. |
| 6,945,303 | B2 | 9/2005 | Weik, III |
| 7,012,503 | B2 | 3/2006 | Nielsen |
| 7,084,736 | B2 | 8/2006 | Ritter |
| 7,821,395 | B2 | 10/2010 | Denison et al. |

(Continued)

*Primary Examiner* — George Bugg
*Assistant Examiner* — Munear Akki
(74) *Attorney, Agent, or Firm* — Ascenda Law Group, PC

(57) ABSTRACT

Electronic locking devices, systems, and methods may employ an accelerometer to detect an acceleration associated with displacement of a portion of an electronic locking device, for example, displacement of a housing that includes a display of the electronic locking device. Responsive to such an acceleration being detected, a message is transmitted to a device remote from the locking device. The message may include a photograph and or audio signal. Concurrently with the transmission of the message, a greeting may be played and/or displayed.

10 Claims, 9 Drawing Sheets

(56) References Cited

U.S. PATENT DOCUMENTS

| | | | | |
|---|---|---|---|---|
| 7,969,304 | B2 * | 6/2011 | Berland et al. .... | B65D 33/1675 235/382 |
| 8,269,627 | B2 * | 9/2012 | Gore et al. ..... | G08B 13/04 292/240 |
| 8,437,740 | B2 | 5/2013 | Despain et al. | |
| 8,671,055 | B2 | 3/2014 | Spodak et al. | |
| 8,756,431 | B1 | 6/2014 | Despain et al. | |
| 8,912,880 | B2 | 12/2014 | Ritter | |
| 9,269,221 | B2 | 2/2016 | Gobbi et al. | |
| 2005/0207087 | A1 * | 9/2005 | Fisher et al. ..... | E05B 19/0005 361/160 |
| 2006/0065024 | A1 * | 3/2006 | Gutierrez et al. ..... | E05B 67/02 70/56 |
| 2010/0198376 | A1 | 8/2010 | Mackenzie et al. | |
| 2010/0283575 | A1 * | 11/2010 | Tubb et al. ..... | E05B 39/00 340/5.1 |
| 2010/0283576 | A1 * | 11/2010 | Loughlin et al. ..... | E05B 37/08 340/5.2 |
| 2013/0194067 | A1 | 8/2013 | Kimbrell | |
| 2013/0278411 | A1 * | 10/2013 | Dibella et al. ..... | E05B 63/00 340/527 |
| 2013/0335222 | A1 * | 12/2013 | Comerford et al. ... | G08B 13/06 340/542 |
| 2014/0002239 | A1 * | 1/2014 | Rayner ..... | G08B 13/1427 340/5.61 |
| 2015/0240521 | A1 * | 8/2015 | Vaknin et al. ..... | E05D 15/06 70/263 |

* cited by examiner

ELECTRONIC LOCKING SYSTEMS, METHODS, AND APPARATUS

RELATED APPLICATIONS

This application is a Continuation-in-Part of co-pending U.S. patent application Ser. No. 13/889,241, filed May 7, 2013, which is (i) a Non-provisional of, claims priority to, and incorporates by reference U.S. Provisional Application No. 61/692,324 filed Aug. 23, 2012, and (ii) a Continuation-in-Part of co-pending International Application No. PCT/ES13/070229, filed Apr. 10, 2013, which designates the United States of America, is incorporated herein by reference, and claims priority to Spanish Patent Application No. ES201230535, filed Apr. 11, 2012, all of which are incorporated by reference in their entirety.

FIELD OF INVENTION

The present invention relates to a system, method, and apparatus for electronically locking and unlocking a locking device and detecting an acceleration or movement thereof.

BACKGROUND

Traditional electronically enabled locks are difficult to program and manage often requiring the direct manual reconfiguration of each lock within a system and it is difficult to update or otherwise manage the access privileges of various users of an electronic lock.

SUMMARY

In accordance with various embodiments of the present invention, an accelerometer is used to detect an acceleration associated with displacement of a portion of an electronic locking device, for example, displacement of a housing that includes a display of the electronic locking device. Responsive to such an acceleration being detected, a message is transmitted to a device remote from the locking device. The message may include a photograph and or audio signal. Concurrently with the transmission of the message, a greeting may be played and/or displayed.

According to one method, an electronic key generation device may receive a data payload. A request to generate an electronic key to a locking device may then be received and the electronic key may be generated responsively to the request. The electronic key may then be transmitted to the locking device.

In an alternative embodiment, an encrypted electronic key may be received at a processor included within a locking device. The key may be received from an electronic key generation device. The electronic key may be decrypted and a data payload may be extracted from the decrypted electronic key. It may then be determined whether the data payload is included within a list of permissible data payloads and a locking mechanism communicatively coupled to the processor and included within the locking device may be instructed to translate from a closed position to an open position or from the open position to the closed position responsively to the determination.

In one embodiment, a request for a data payload may be transmitted to a server. The request may include information specific to an electronic key generation device. The requested data payload may then be received from the server by the administrative device. The requested data payload may enable a receiving electronic key generation device to generate an electronic key. The received data payload may then be transmitted from the administrative device to the electronic key generation device.

In another embodiment, an acceleration of a portion of the locking device may be detected by an accelerometer coupled to the locking device. An indication of the detected acceleration may be transmitted to a processor and the processor may instruct the locking device to transmit a message to a remote user, which is then transmitted to the remote user. The message may include an indication alerting the remote user the detected acceleration as well as additional information gathered by the locking device.

BRIEF DESCRIPTION OF THE DRAWINGS

The present application is illustrated by way of example, and not limitation, in the figures of the accompanying drawings, in which.

Figure 1:
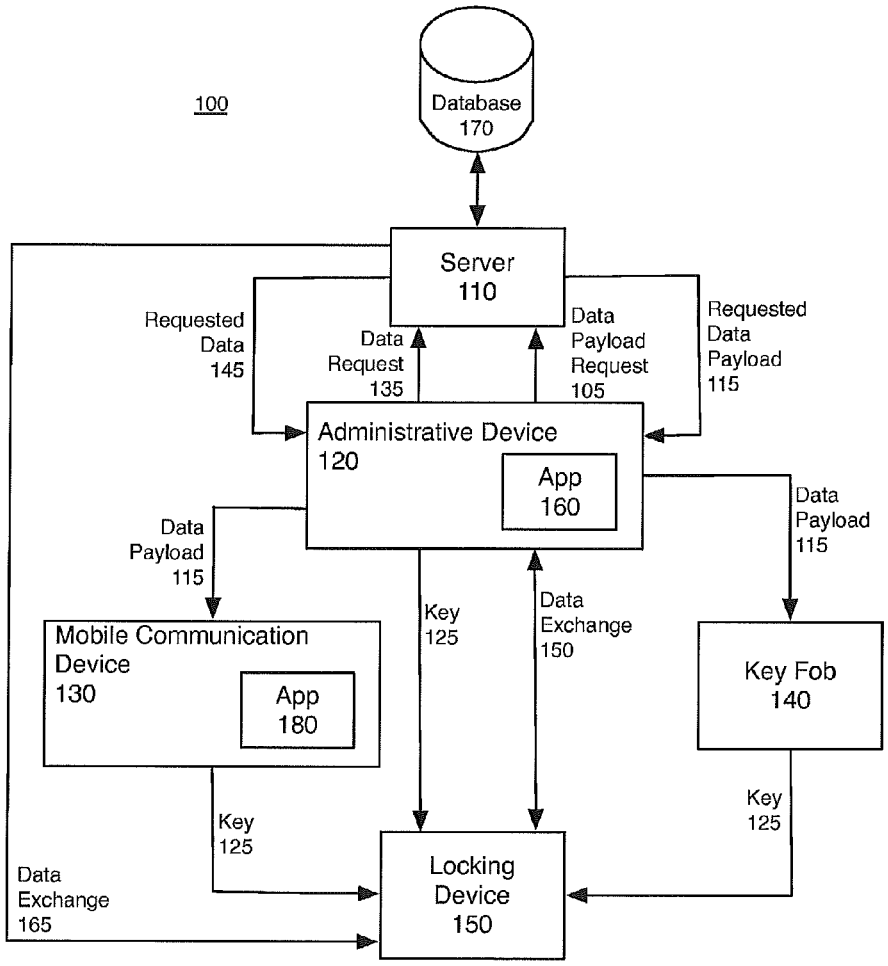
FIG. 1 depicts a block diagram of an exemplary locking system, consistent with an embodiment of the present invention.

Throughout the drawings, the same reference numerals and characters, unless otherwise stated, are used to denote like features, elements, components, or portions of the illustrated embodiments. Moreover, while the subject invention will now be described in detail with reference to the drawings, the description is done in connection with the illustrative embodiments. It is intended that changes and modifications can be made to the described embodiments without departing from the true scope and spirit of the subject invention as defined by the appended claims.

DESCRIPTION

An electronically enabled locking device with a manual override feature is herein disclosed. The electronically enabled locking device may be capable of receiving (e.g., over the air via a wireless communication path) a electronic token (e.g., an electronic key) from a user-operated portable device (e.g., a mobile phone or fob) and then, responsive to verification of the key, opening or closing the latch. The manual override feature may be activated by a user inserting a physical key in the cylinder of the locking device and turning the key, thereby displacing the latch from a closed position to an open position, or vice-versa. At times, the manual override feature may be fully or partially covered by a movable housing such that when the housing is moved, the manual override feature (e.g., the keyhole) is exposed. The housing may include an accelerometer configured to detect acceleration or motion of the housing as may occur when the housing is moved to expose the manual override feature. Optionally, locking device may trigger transmission of an alert to a user responsively to the detection of movement of the housing and/or locking device by the accelerometer.

FIG. 1 depicts a block diagram of a locking system 100. The components of locking system 100 may be communicatively coupled via wired and/or wireless communication links. At times, a communication network (not shown) may facilitate wireless communication between the components of locking system 100 such as a local area network (LAN), a wireless LAN (WLAN), and/or the Internet.

Exemplary components of locking system 100 include a server 110, an administrative device 120, a mobile communication device 130, a key fob 140, a locking device 150, and a database 170. Optionally, a software application, or app, 180 may reside within mobile communication device 130. A software application 160 may also reside on administrative device. Software applications 160 and 180 may be modified versions of one another such that software application 160 grants more administrative/management access to locking system 100 than software application 180. On some occasions, administrative device 120, mobile communication device 130, and/or key fob 140 may be collectively referred to as an electronic key generation device.

Administrative device 120 may be, for example a mobile communication device (e.g., a mobile phone, tablet computer, or laptop computer) or a stationary communication device (e.g., desktop computer) enabled to communicate with the components of locking system 100. In some embodiments, communication with components of locking system 100 may be facilitated by software application 160 running on administrative device 120. In some instances, communication between administrative device 120 and one or more components of locking system 100 may be facilitated by a website provided via the Internet.

Administrative device 120 may be configured to administer and/or manage one or more components of locking system 100. For example, administrative device 120 may be configured to communicate a data payload request 105 to server 110. Data payload request 105 may include information useful to server 110 when generating the requested data payload. For example, data payload request 105 may include one or more identifying attributes for an intended recipient of the data payload, such as mobile communication device 130, administrative device 120, and/or key fob 140. In some embodiments, data payload request may include one or more rules concerning the intended recipient's access privileges (e.g., locking and/or unlocking privileges) to locking system 100. Exemplary rules concerning access privileges include date and/or time periods within which an intended recipient may gain entry to a facility including locking system 100 and, in some cases, may include a periodic frequency (e.g., a particular day, range or days, or time of day) for granting access to locking system 100. Additionally, or alternatively, the rules may include one or more personalized instructions or messages (e.g., a personalized greeting or status update).

Upon receipt of data payload request 105, server 110 may generate a requested data payload 115 and transmit same to administrative device 120. On some occasions, data payload 115 may be encrypted using one or more encryption methods prior to transmission to administrative device 120. Administrative device 120 may then store data payload 115 for future use and/or transmit data payload 115 to, for example, mobile communication device 130 and/or key fob 140. Optionally, administrative device 120 may transmit the encrypted data payload 115 or may decrypt the data payload 115 prior to transmission. On some occasions, when the data payload 115 received from server 110 is not encrypted, administrative device 120 may encrypt data payload 115 prior to transmission.

Upon receipt of data payload 115, administrative device 120, mobile communication device 130, and/or key fob 140 may be enabled to generate an electronic key 125 using data payload 115. On some occasions, data payload 115 and/or electronic key 125 may be unique to the receiving administrative device 120, mobile communication device 130, and/or key fob 140.

At times, security measures installed upon a receiving device and/or within data payload 115 and/or electronic key 125 may prevent data payload 115 and/or electronic key 125 from being copied or otherwise transferred from the intended recipient to another device. However, at times, such copying and/or transference of data payload 115 and/or electronic key 125 to another device may be allowed by, for example, administrative device 120 and/or server 110.

Mobile communication device 130 and/or key fob 140 may be any device enabled to store data payload 115, generate an electronic key 125, and communicate with the components of system 100 via, for example, cellular communications, Wi-Fi communications, and/or an electromagnetic signal including, but not limited to, an ultrasonic signal, an infrared signal, a short-wavelength radio signal, a telecommunication signal, a cellular communication signal, a near-field radio signal, a Bluetooth™ signal, a Bluetooth™ low energy signal, and a Wi-Fi signal.

In addition, mobile communication device 130 may be enabled to store and run software application 180. Software application 180 may enable generation and transmission of the electronic key 125 to locking device 150. Software application 180 may further enable communication between mobile communication device 130 and administrative device 120 and/or locking device 150.

Locking device 150 may be any device in able to lock and/or unlock a facility responsively to receiving electronic key 125. Further details with regard to the components and functions performed by locking device 150 are provided below with regard to FIGS. 3 and 4. In some embodiments, locking device 150 may be enabled to record activity associated with locking device 150 (e.g., locking and/or unlocking of the device and alarm conditions generated by the device) and, in some cases, may transmit these records to, for example, server 110 via data exchange 165. Additionally, or alternatively, locking device 150 may receive information regarding the access privileges associated with one or more electronic keys 125 via data exchange 165. In some embodiments, some and/or all data exchanged between locking device 150 and server 110 may be stored in database 170.

In some embodiments, the administrative device 120 may be enabled to request data regarding the operation of locking system 100 from server 110 via transmission of a data request 135. Server 110 may then transmit requested data 145 to administrative device 120. Exemplary requested data 145 may include, for example, a status of locking device 150 (e.g., locked or unlocked), an indication of accesses or attempted accesses of locking device 150, in indication of the status for mobile communication device 130 and/or key fob 140.

At times, communication between administrative device 120 and server 110 may be implemented via a website facilitated by a network, such as, the Internet. Such communication may include, for example, transmission of requests, such as data payload request 105 and data request 135 and receipt of data, such as data payload 115 and requested data 145. Administrative device 120 may also manage system 100 via the website and may, for example, establish access privileges for itself, mobile communication device 130, and/or key fob 140. Management of system 100 may also include modification of access privileges for mobile communication device 130 and/or key fob 140 and sending a notification to server 110 and/or locking device 150 of the modification. Administrative device 120 may also access data stored in database 170 via the website. In some embodiments, administrative device 120 may be able to configure one or more settings of locking device 150 via, for example, direct interaction with locking device 150 and/or the website.

In some embodiments, locking system 100 may include a plurality of mobile communication devices 130, key fobs 140, and/or locking devices 150. In some instances, the operation of the plurality of components may be linked or otherwise associated, while in other instances, this may not be the case. For example, in an embodiment wherein locking system 100 includes a plurality of locking devices 150, locking system 100 may be configured such that a change to one locking device 150 may be communicated to some, or all, of the remaining locking devices 150 included within locking system 100. In an alternative embodiment, the opposite may be true such that a change to one locking device 150 has no effect upon the remaining locking devices 150 included within locking system 100.

Figure 2:
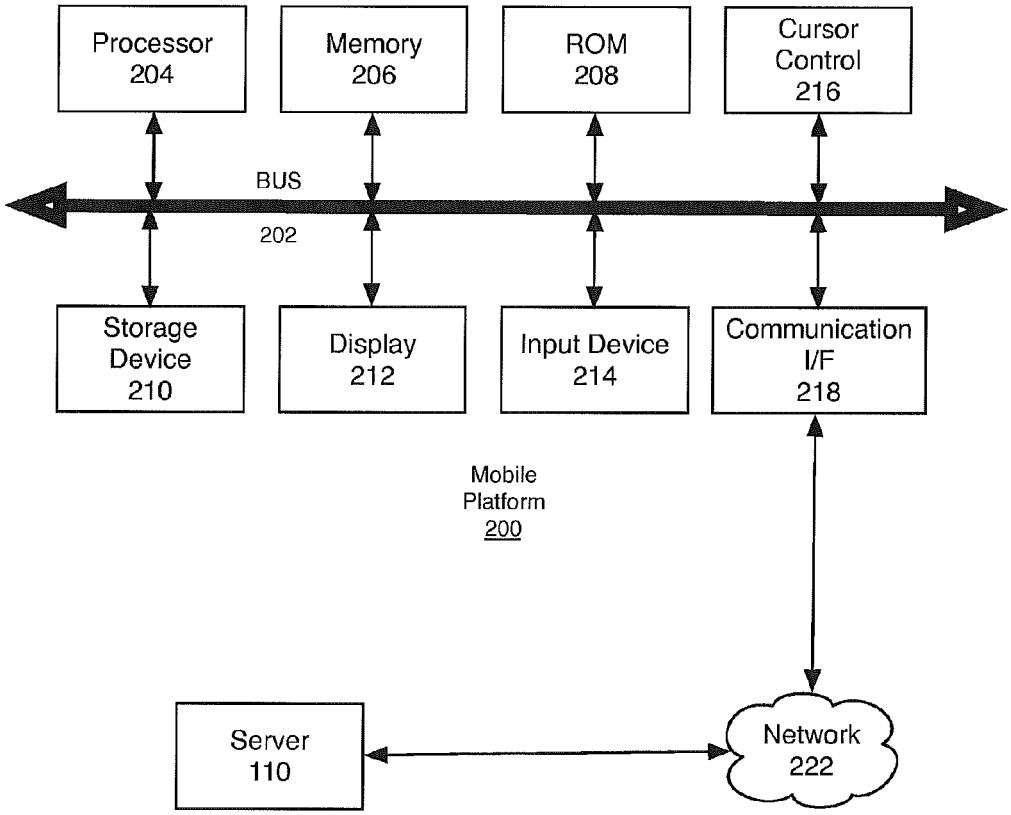
FIG. 2 illustrates an exemplary platform upon which instantiated of the present invention may be realized.

As should be evident from the foregoing discussion, various embodiments of the present invention may be implemented with the aid of computer-implemented processes or methods (a.k.a. programs or routines) that may be rendered in any computer-readable language. An example of an administrative device or mobile communication device platform 200 on which embodiments of the present invention may be instantiated (e.g., in the form of computer-readable instructions stored in one or more computer-readable storage mediums such as, but not limited to, any type of disk including floppy disks, optical disks, compact disk read only memories (CD-ROMs), and magnetic-optical disks, read-only memories (ROMs), flash drives, random access memories (RAMs), erasable programmable read only memories (EPROMs), electrically erasable programmable read only memories (EEPROMs), flash memories, other forms of magnetic or optical storage media, or any type of media suitable for storing electronic instructions) is shown in FIG. 2.

Platform 200 includes a bus 202 or other communication mechanism for communicating information, and a processor 204 coupled with the bus 202 for processing information. Platform 200 also includes a main memory 206, such as a RAM or other dynamic storage device, coupled to the bus 202 for storing information and instructions to be executed by processor 204, such as software application 160 and/or 180. Main memory 206 also may be used for storing temporary variables or other intermediate information during execution of instructions to be executed by processor 204. Platform 200 further includes a ROM 208 or other static storage device coupled to the bus 202 for storing static information and instructions for the processor 204. A storage device 210, such as a flash drive, is provided and coupled to the bus 202 for storing information and instructions.

Platform 200 may also include a display 212 for displaying information to a user. An input device 214, including alphanumeric and other keys, may be provided as well (e.g., for communicating information and command selections to the processor 204). Another type of user input device is cursor control 216, such, gestural control, a trackball or cursor direction keys, may be provided for communicating direction information and command selections to processor 204 and for controlling cursor movement on the display 212. In other instances, the alphanumeric and cursor inputs may be provided via a touch-sensitive display.

According to one embodiment of the invention, the forgoing methods and data structures are instantiated in computer software executed by platform 200, which is by processor 204 executing sequences of instructions contained in main memory 206. Such instructions may be read into main memory 206 from another computer-readable medium, such as storage device 210. Execution of the sequences of instructions contained in the main memory 206 causes the processor 204 to perform the process steps described herein.

Platform 200 may also include a communication interface 218 coupled to the bus 202. Communication interface 208 provides for two-way data communication to and from the platform 200. For example, communication interface 218 may include a wireless radio configured to operate with a telecommunication carrier's network and/or a computer communication network (e.g., a Wi-Fi or other such network). In any such implementation, communication interface 218 sends and receives electrical, electromagnetic or optical signals, which carry digital data streams representing various types of information. For example, two or more platforms 200 may be networked together with each using a respective communication interface 218. Also, a platform 200 may communicate with a server 110 (e.g., one which provides the evaluation service discussed above) via communication interface 218 and a network 222.

Figures 3A, 3B:
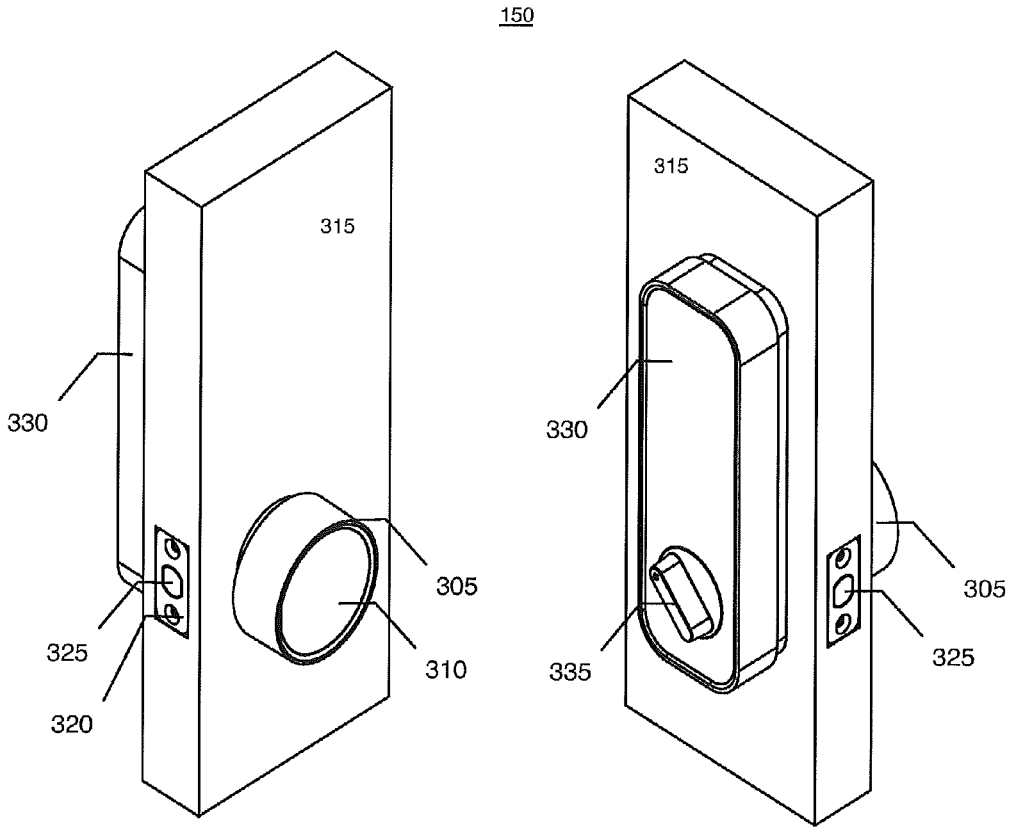
FIGS. 3A-3C illustrate various views of an exemplary locking apparatus when installed within a door, consistent with an embodiment of the present invention.

FIG. 3A illustrates a front perspective view of an exemplary locking device 150 placed within a door 315. Locking apparatus 300 includes a housing 305 and a control panel 330 affixed to either side (e.g., front and back) of door 315. Control panel may house one or more components configured to operate locking apparatus 300, such as, but not limited to a power source, a processor, and a transceiver. At times, one or more components included within locking apparatus 300 may be network enabled and may be connected to, for example, a server (not shown). Exemplary networks include the Internet, a local area network (LAN) and/or a wireless LAN (WLAN).

Housing 305 may include a faceplate 310. Locking device 150 may further include a deadbolt 325 positioned within a bracket 320 that may be affixed to door 315. FIG. 3B illustrates a rear perspective view of locking device 150 placed within door 315 wherein control panel 330 includes a thumb turn 335 for manually locking and unlocking deadbolt 325.

Figure 3C:
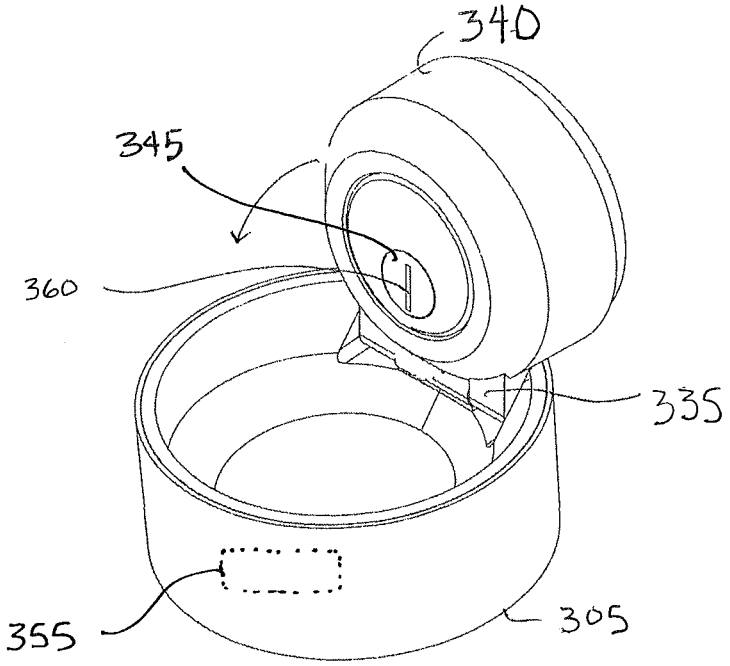

FIG. 3C illustrates a front perspective view of housing 305 in an open position thereby exposing a portion of a physical key cylinder housing 340. Housing 305 may be articulated from an open position to a closed position or vise versa via, for example, a hinge 335 or other articulation mechanism (e.g., a peg around which the housing rotates). Physical key cylinder housing 340 may include a physical key cylinder 345 configured to accept manual entry of a key via a keyhole 360. The key may be operative to reposition deadbolt 325 from an unlocked position to a locked position or from the locked position to the unlocked position when turned in keyhole 360.

Locking device 150 may include an accelerometer 355 configured to detect proper acceleration, vibration, or movement of locking device 150, a portion thereof, or a structure (e.g., door 315) housing locking device 150 in one, two, or three dimensions. In the embodiment of FIG. 3C, accelerometer 355 is depicted as resident within housing 305, however this is not necessarily the case. Exemplary vibration or movement may be caused by, for example, an individual knocking on door 315 or jiggling a door handle affixed to door 315 (not shown). Accelerometer 355 may also be enabled to detect acceleration of housing 305 consistent with movement of housing 305 so as to expose physical key cylinder housing 340 or a portion thereof or an attempt to remove housing 305 and/or locking device 150 from door 315.

Figure 4:
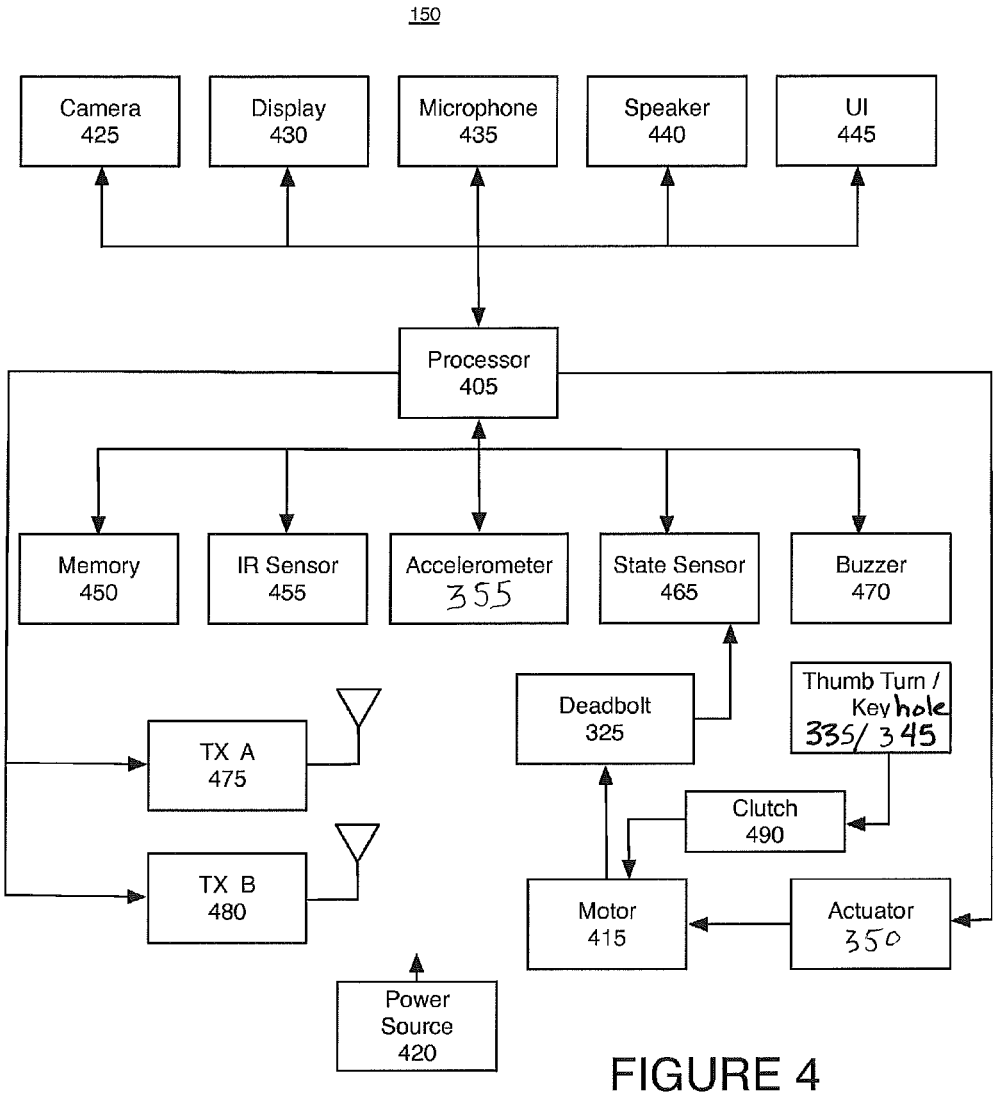
FIG. 4 depicts a block diagram of an exemplary locking device, consistent with an embodiment of the present invention.

FIG. 4 is a block diagram depicting exemplary components of locking device 150. The components depicted in FIG. 4 are provided by way of example and are in no way intended to limit the scope of the present invention. Locking device 150 may include a processor 405 communicatively coupled to the components of locking device 150 and may be capable of executing one or more methods described herein via interaction with these components.

Processor 405 may be coupled to power source 420. Exemplary power sources 420 include batteries, rechargeable batteries, a wired electrical connection, and/or some combination thereof. Locking device 150 may include one or more transceivers, such as, transceiver A 475 and transceiver B 480. Transceivers A and B 475 and 480 may be enabled to communicate via, for example, electromagnetic or cellular signals, including but not limited to radio signals, ultrasonic signals, infrared signals, short-wavelength radio signals, telecommunication signals, cellular communication signals, near-field communications (NFC) signals, Bluetooth™ signals, Bluetooth™ low energy signals, and Wi-Fi signals. Transceivers A and B 475 and 480 may be communicatively coupled to a server, such as server 110 via a communication network.

Transceivers A and B 475 and 480 may be configured to receive electronic key 125 and forward the received electronic key 125 to processor 405. Processor may then verify the access privileges associated with electronic key 125 and, upon verification may send an instruction to actuator 350. The instructions sent to actuator 350 may, in turn, induce actuator 350 to operate motor 415, enabling the translation of deadbolt 325 from an open position to a closed position or from a closed position to an open position thereby opening or closing locking device 150, as appropriate. Also shown in the diagram are manual controls such as thumb turn 335 and/or physical key cylinder 345 that act upon the deadbolt 325 directly (e.g., to open or close the lock). Also present is a clutch 490 to decouple the deadbolt from the motor so as to allow translation of the deadbolt by the thumb turn 335 or the physical key cylinder 345.

In some embodiments, locking device 150 may include various components designed to enhance the functionality of locking device 150. For example, locking device 150 may include a camera 425 enabled to, for example, image in individual attempting to operate locking device 150. Display device 430 may be enabled to display information to a user. Exemplary information provided by display device 430 includes a personalized greeting, a status of locking device 150, and instructions regarding the operation of locking device 150. In one embodiment, the personalized greeting may include display of an image, for example an image of the last person to lock or unlock the locking device. The picture may be a default image or an image captured by a camera associated with the locking device. Alternatively, the image may be a picture of the user associated with the key being used to lock or unlock the locking device. Locking device 150 may further include a user interface 445 enabled to accept input from a user. In some cases, user interface 445 may include touchscreen capability for display 430.

In one embodiment, locking device 150 may further include a microphone 435 configured to capture an audio signal and/or a speaker 440 or buzzer 470 configured to transmit an audio signal. In this embodiment, microphone 435 and/or speaker 440 may be set up so as to enable one way and or two-way communication between an individual attempting to gain entry to a facility via locking device 150 and an administrator or security professional administering locking device 150 or facility.

Locking device 150 may further include an infrared sensor enabled to detect whether an individual is sufficiently close to locking device 150 to authorize operation (e.g., opening or closing) of locking device 150. For example, processor 405 may require infrared detection indicating that the user is within 1 meter of locking device 150 prior to authorizing a translation of deadbolt 325.

Accelerometer 355 may be configured to transmit an indication of detected acceleration, movement, or vibration of locking device 150 and/or housing 305 to processor 405. Once received, processor 405 may analyze the indication to determine an action or a series of actions in accordance with a set of instructions stored on memory 450 and/or processor 405. Exemplary actions include provision of a message to an individual proximate to locking device 150 via display 430 or microphone 440 and transmission of a message to a remote user and/or an administrator of locking device 150 for display on a device of the user/administrator, such as mobile communication device 130 and/or administrative device 120. Message transmission may be implemented by transceiver A 475 and/or transceiver B 480.

On some occasions, the indication may be consistent with a likely security or vandalism threat, such as an attempt to remove locking device 150 from a door housing the—14—locking device or exerting a force on locking device that may result in breakage of one or more components of locking device. On these occasions, processor 405 may send an alert to the local police, or sound a local alarm.

The action initiated by processor 405 may be set by default. For example, a default setting may be established so that every time an indication of movement is received by processor 405, processor 405 instructs display 430 and/or speaker 440 to provide a message (e.g. a greeting) or instructs camera 425 to take a picture or series of pictures of the area proximate to locking device which may be stored in memory 450 and/or transmitted to a user and/or administrator via transceiver A 475 and/or transceiver 475 B 280.

Additionally, or alternatively, the action initiated by processor 405 may be configurable by user or administrator. For example, a user may configure processor 405 to perform a certain action in response to receipt of every indication of a detected acceleration and/or the action performed may be specific to a characteristic or feature of the indication. For example, when processor 405 determines a received indication of movement is consistent with knocking, a user may configure processor 405 to instruct display 430 and/or speaker 440 to provide a message (e.g. a greeting or request to wait until the door is opened) to the individual knocking and/or transmit that picture to a remote user of locking device 150 for display on a device of the remote user, such as mobile communication device 130 and/or administrative device 120. Transmission of the picture may be accompanied with other information such as date, time, type of movement/acceleration detected, etc.

For example, when processor 405 determines that the indication of movement is consistent with an individual knocking on a door housing locking device 150, processor 405 may instruct camera 425 to take a picture of the individual knocking (or an area where it is expected the individual will be standing) and then transmit that picture to a remote user of locking device 150 for display on a device of the user, such as mobile communication device 130 and/or administrative device 120.

In another example, when processor 405 determines that the indication of movement is consistent with a movement of housing 305 so as to expose physical key cylinder housing 340, processor 405 may instruct camera 425 to take a picture of the individual knocking (or an area—15—where it is expected the individual will be standing) and then transmit that picture to a user of locking device 150 for display on a device of the user, such as mobile communication device 130 and/or administrative device 120, provide a message to an individual moving the physical key cylinder housing 340 via display 430 and/or speaker 440, or send an alert/alarm to the user and/or a security service, which may be employed by the user or otherwise (e.g., local police or private security service).

In some embodiments, locking device 150 may further include a state sensor 465 enabled to detect the state (e.g., open or closed) of deadbolt 325 and/or a structure (e.g., door 115) housing locking device 150.

Information gathered by one or more of the components of locking device 150 may be recorded in, for example, memory 450. Recorded information may be transmitted to, for example, administrative device 120 and/or server 110 on for example, an as-needed, as-requested, and/or periodic basis. When the recorded information is transmitted to server 110, it may be stored in database 170.

Figure 5:
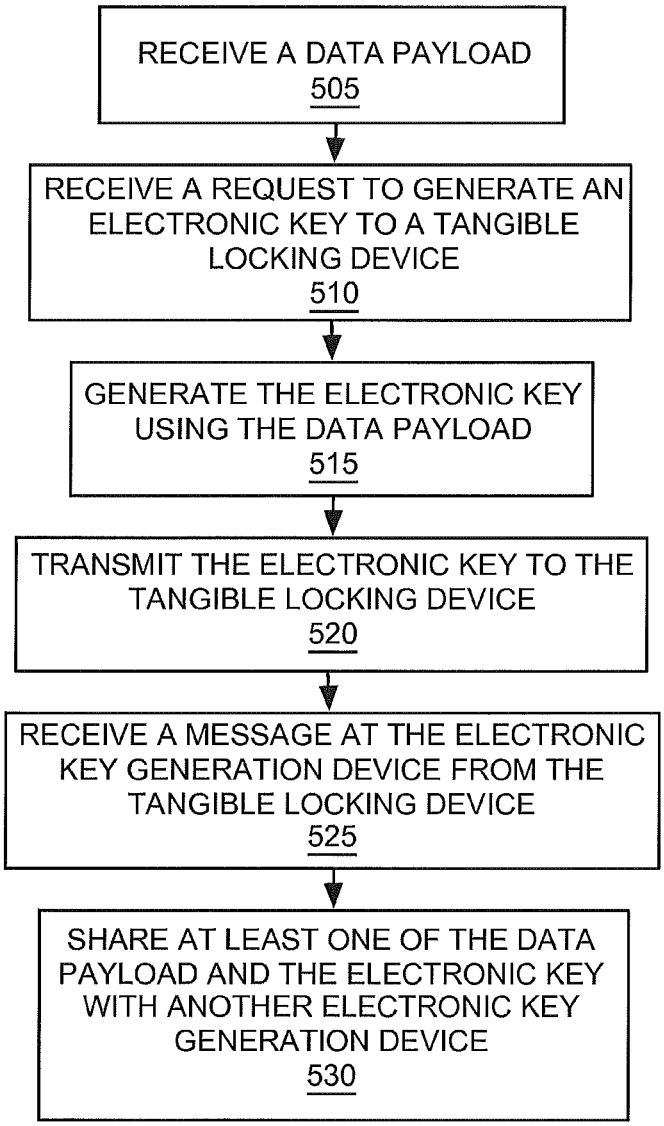
FIGS. 5-8 depict flowcharts for various processes executed by one or more components of a locking system configured in accordance with embodiments of the present invention.
Figure 6:
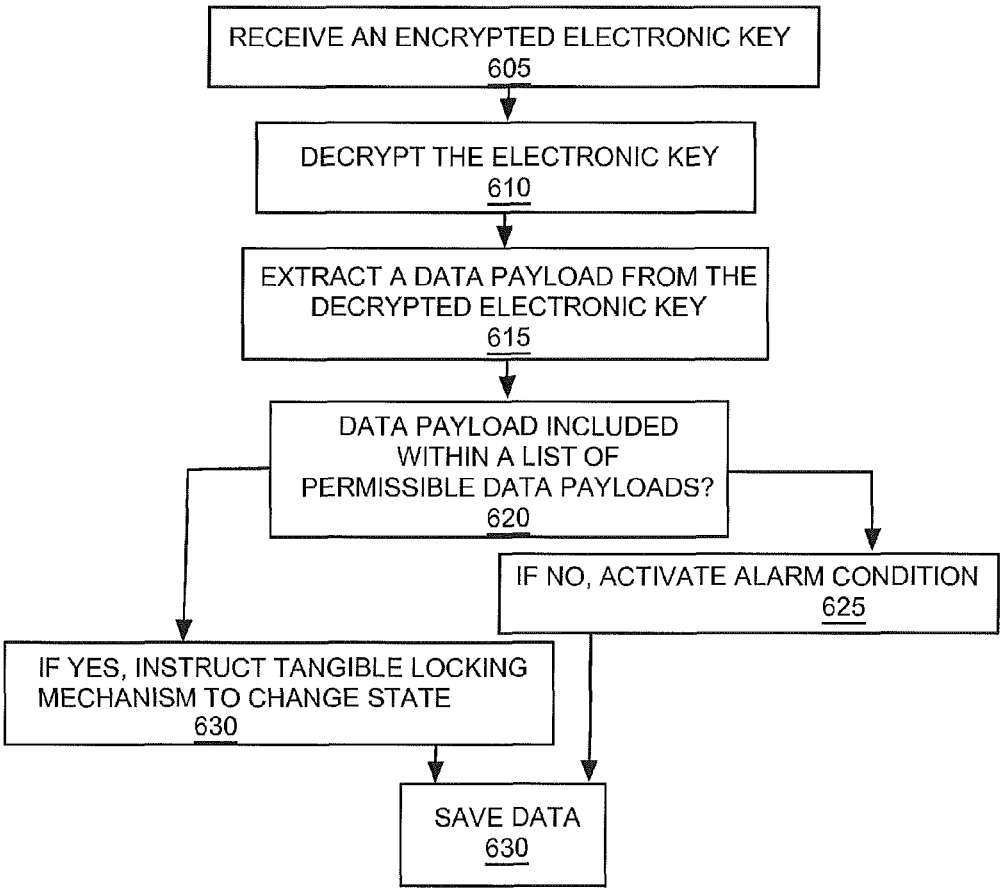
Figure 7:
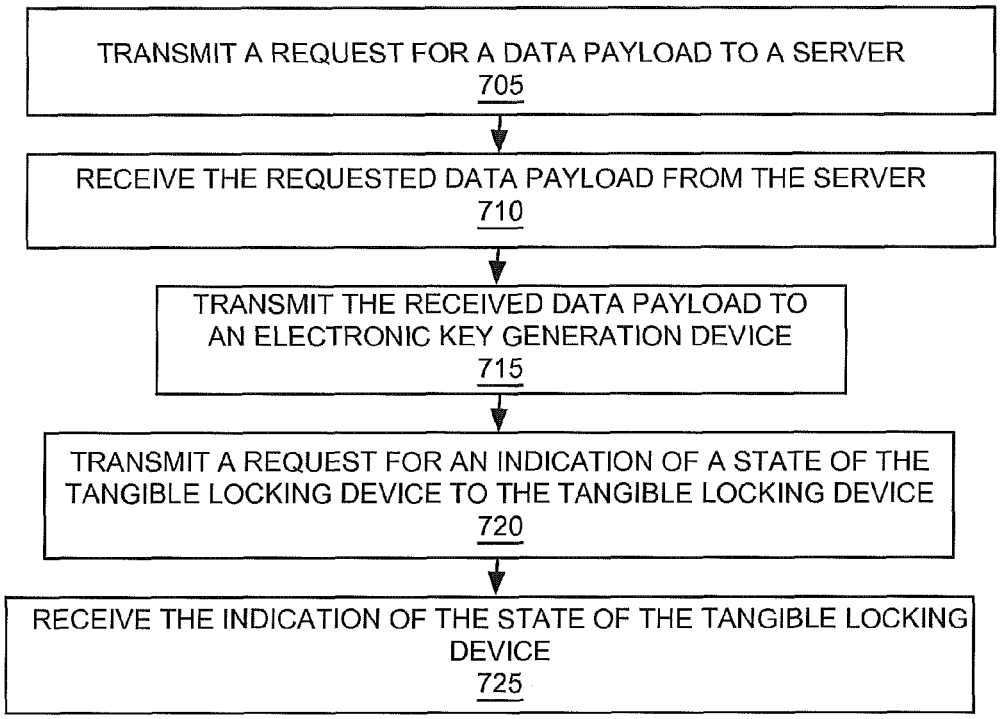

FIGS. 5-7 depict flowcharts for various processes executed by one or more components of the present invention. For example, execution of one or more steps of processes depicted in FIGS. 5-7 may be executed by an electronic key generation device, such as administrative device 120, mobile communication device 130 and/or key fob 140 when attempting to operate a locking device like locking device 150. On some occasions, execution of one or more steps of processes depicted in FIGS. 5-7 may be executed by way of a software application (e.g., software application 160 and/or 180) running on the electronic key generation device and/or administrative device.

As depicted in FIG. 5, process 500 begins when the electronic key generation device receives a data payload, such as data payload 115 (step 505). In step 510, a request to generate an electronic key may be received from, for example, a user of the electronic key generation device. The electronic key may include instructions to enable the locking and/or unlocking of the locking device. On some occasions, the electronic key may further include instructions to relock an opened lock, or reopen a closed lock, after the conclusion of a defined time period.

The electronic key may then be generated responsively to the request (step 515) and may be transmitted to the locking device (step 520) whereupon the locking device may verify the electronic key and, upon verification, proceed to open and/or close the lock. Exemplary modes of transmission of the electronic key include a wireless electromagnetic signal, such as cellular signals, radio signals, ultrasonic signals, infrared signals, short-wavelength radio signals, telecommunication signals, cellular communication signals, NFC signals, Bluetooth™ signals, Bluetooth™ low energy signals, and Wi-Fi signals.

Optionally, the electronic key generation device may receive a message from the locking device (step 525). Exemplary messages include personalized greetings (e.g., such as those discussed above) or a status of the locking device (e.g., open or closed). In some embodiments, the content of the message may be included within the electronic key.

As depicted in FIG. 6, process 600 begins, when an encrypted electronic key, similar to electronic key 125 is received by a locking device similar to locking device 150 receives (605). The electronic key may be received by a transceiver, such as transceivers A and B 475 and 480 via, for example, wireless electromagnetic signals, such as cellular signals, radio signals, ultrasonic signals, infrared signals, short-wavelength radio signals, telecommunication signals, cellular communication signals, NFC signals, Bluetooth™ signals, Bluetooth™ low energy signals, and Wi-Fi signals.

The encrypted electronic key is then decrypted (step 610) and a data payload, similar to data payload 115 may be extracted from the encrypted data (step 615). Then, in step 620, it may be determined whether the decrypted data payload is included on a list of permissible data payloads. When the decrypted data payload is not included on a list of permissible data payloads, an alarm condition may be activated (step 625). Exemplary alarm conditions include an audio signal emanating from the locking device, a message displayed upon the locking device, transmission of an alert to an administrator, such as administrative device 120, and/or transmission of an alert to a security agency (e.g., police or private security company). When the decrypted data payload is included on a list of permissible data payloads, lock drive means within the locking device, (in one embodiment instantiated as actuator 350, motor 415, state sensor 465 and deadbolt 325), may be instructed to change state (e.g., translate from a closed position to an open position or from the open position to the closed position) (step 630). Finally, whether the decrypted data payload is not included on a list of permissible data payloads, or not, data regarding the execution of process 600 may be recorded (step 630).

At times, prior to execution of step 605, the locking device may receive a list of permissible data payloads from an administrative device, such as administrative device 120. The list may then be stored in, for example, a memory communicatively coupled to the locking device. On some occasions, a modification to the list may also be received by the locking device and the list of permissible data payloads may be updated and stored accordingly.

In some embodiments, process 700 may include transmitting a message from the locking device to the electronic key generation device. In some cases, for example when the data payload associated with an electronic key is not included within the list of permissible data payloads, the message sent to the electronic key generation device may act to disable, or otherwise nullify, the electronic key generation device.

As depicted in FIG. 7, process 700 begins when a request for a data payload is transmitted by administrative device, such as administrative device 120, to a server, such as server 110 (step 705). In step 710, the requested data payload, such as data payload 115, may be received from the server at the administrative device. The data payload may be in an encrypted, or unencrypted, format. The administrative device may then transmit the received data payload in an encrypted or unencrypted format to an electronic key generation device such as, mobile communication device 130 or key fob 140 (step 715).

Optionally, administrative device may transmit a request for an indication of the state of the locking device (e.g., open or closed) to the locking device (step 720) and an indication of the state of the locking device may be received responsively to the request (step 725).

Figure 8:
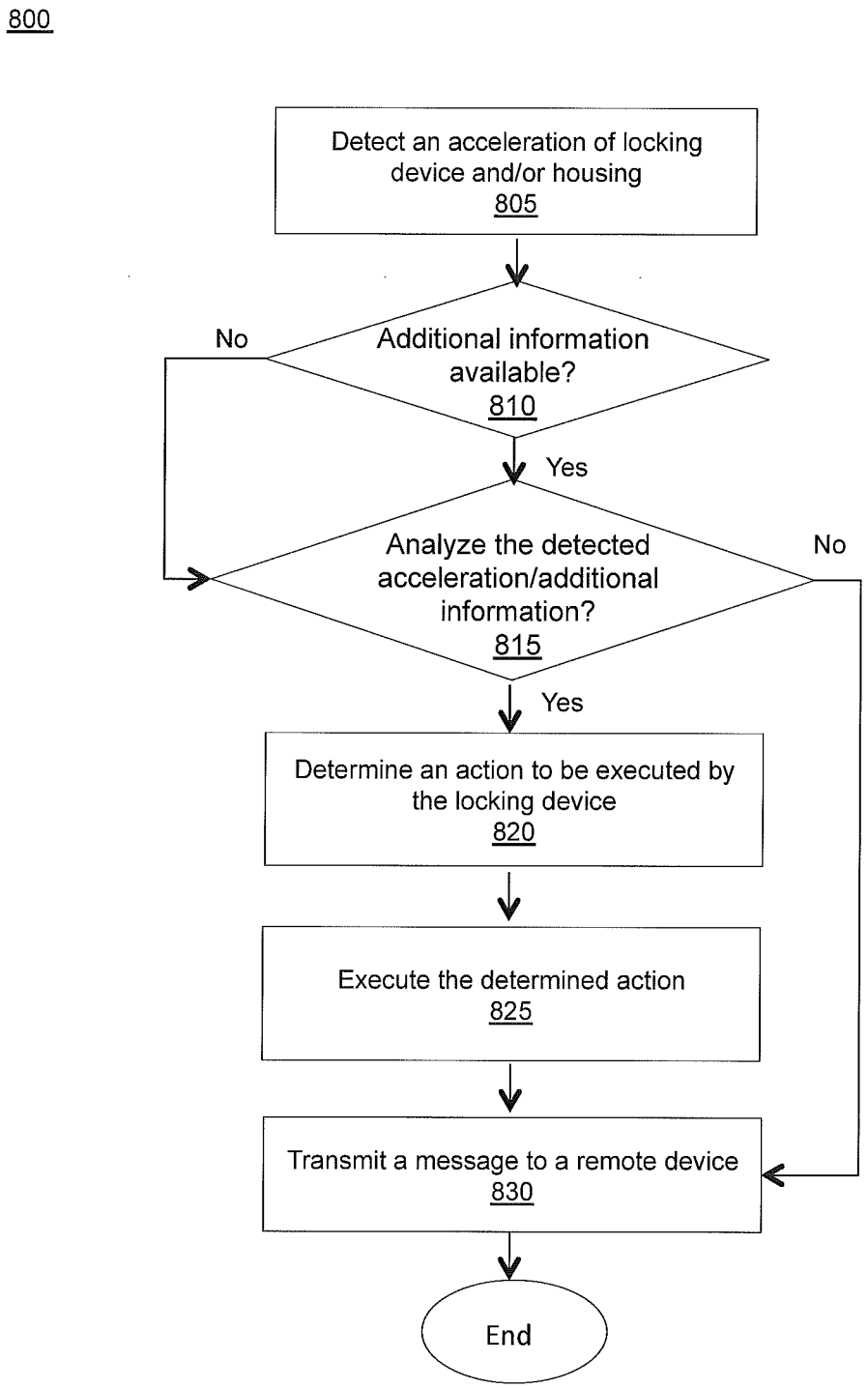

As depicted in FIG. 8, process 800 begins with detection of an acceleration or movement of a locking device, such as locking device 150 and/or a housing, such as housing 305 by an accelerometer, such as accelerometer 355 (step 805). The detected acceleration may be caused by, for example, an individual moving a door housing the locking device or the housing. The acceleration or movement may be caused by knocking on the door, twisting the housing (e.g. exerting a torque on the housing), or rotating the housing about a hinge so as to expose a physical key cylinder housing, such as physical key cylinder housing 340 or a physical keyhole, such as physical keyhole 360. In many cases, an indication of the detected acceleration may be transmitted to a processor within the locking device, such as processor 405 to, for example, trigger an action such as the transmission of a message to a remote user and/or the collection of additional information or for analysis consistent with process 800.

At times, it may be determined whether additional information regarding the circumstances of the detected acceleration and/or the locking device may be available (step 810). In some instances, such information may be collected as part of a periodic or continuous monitoring protocol, while in other instances the collection of such information may be triggered by the detection of an acceleration of the locking device. Exemplary additional information includes, a state of a door as may be determined by a state sensor, such as state sensor 465 and an image or a series of images of an area proximate to the locking device, time of day, and environmental factors.

Optionally, the detected acceleration and/or additional information (when available) may be analyzed to, for example, determine one or more characteristics thereof (step 815). The analysis may be performed by, for example, a processor such as processor 405 upon receipt of an indication of the detected acceleration from the accelerometer and/or additional information. At times, the analysis of step 815 may include determining a characteristic of the detected acceleration, such as a magnitude, direction, or duration of the detected acceleration. On some occasions, the characteristic may be included in the message of step 830 as discussed below.

When the detected acceleration is to be analyzed, an action to be executed by the locking device may be determined responsively to the analysis (step 820). The action may then be executed by the locking device (step 825) responsively to, for example, receipt of an instruction to do so from the processor. In most embodiments, the action will not be an opening or closing of the locking device. On some occasions, the action may be capturing an image or a series of images of an area proximate (e.g., in front of) locking device with a camera, such as camera 425, so as to, for example, capture an image of an individual causing the acceleration of the locking device. Additionally, or alternatively, the action may be capturing a recording of sounds being made at an area proximate (e.g., in front of) locking device with a microphone, such as microphone 435 at or near the time of occurrence for the detected acceleration. In some instances, the action to be executed may be no action. For example, if the locking device is accelerated while the door housing the locking device is open as may be the case when the door is opened and is accidentally bumped by an individual passing through the doorway, the processor, upon analyzing the acceleration and additional information, may determine that an action, such as sending a message to a remote user is unnecessary. In one embodiment, the action may be the provision of a visual and/or auditory greeting for communication to an individual causing the detected acceleration upon detection of an acceleration of the locking device.

Whether the detected acceleration is analyzed, or not, the locking device transmits a message providing information regarding the detected acceleration to a remote device (step 830). At times, transmission of this message may be the action executed by locking device in step 825. The message may be, for example, a request to assist an individual attempting to open a door housing the locking device or an alert to a security service indicating a potential unauthorized opening or attempt to open the door.

The message transmission may be performed by a transceiver resident in the locking device, such as transceiver A 475 or transceiver B 480 and may be responsive to an instruction received from the processor. Exemplary remote devices include a mobile communication device operated by a remote user, such as mobile communication device 130 and an administrative device operated by an administrator such as administrative device 120. Exemplary remote users include a user/owner/operator of the locking device, a trusted associate of the user/owner/operator of the locking device (e.g., a relative or friend), a private security service, a law enforcement organization, and a police force. In some embodiments, the action performed in step 820 and/or the message of step 830 may be user configurable.

Thus, electronic locking systems, apparatus, and methods and detecting an acceleration or movement thereof have been herein described.

What is claimed is:

1. A method comprising:

detecting, by an accelerometer, an acceleration associated with displacement of a portion of a locking device;

transmitting, by the accelerometer, an indication of the acceleration to a processor communicably coupled to the accelerometer;

determining, by the processor, whether the acceleration associated with the displacement of the portion of the locking device indicates exposing of a physical key cylinder housing to permit use of a physical key in a key hole of the locking device; and, when the processor determines that the acceleration indicates the exposing of a physical key cylinder housing to permit the use of the key in the key hole of the locking device, initiating, by the processor, transmission of a message to a device remote from the locking device, said message providing information regarding the use of said key in the locking device, said transmission being by a transceiver associated with the locking device and communicably coupled to the processor, otherwise, not initiating said transmission.

2. The method of claim 1, further comprising:

analyzing, by the processor, the indication of the acceleration to determine a characteristic of the acceleration associated with the displacement;

determining, by the processor, an action, other than an opening or closing of the locking device, to be executed by the locking device responsively to the determined characteristic;

instructing, by the processor, the locking device to perform the determined action; and performing, by the locking device, the determined action responsively to the received instruction.

3. The method of claim 1, wherein the content of the message is user configurable.

4. The method of claim 1, wherein the message includes at least one of: a photograph of an area proximate to the locking device taken at a time corresponding to the detected acceleration and an audio recording of an area proximate to the locking device taken at a time corresponding to the detected acceleration.

5. The method of claim 1, wherein the content of the message includes an indication of a likely cause of the detected acceleration.

6. The method of claim 1, further comprising:

instructing, by the processor, the locking device to issue a greeting; and providing, by the locking device, the greeting.

7. The method of claim 6, wherein the greeting is provided via at least one of a display of the locking device and a speaker associated with the locking device.

8. The method of claim 1, wherein the displacement of the portion of the locking device corresponds to displacement of a display of the locking device.

9. An electronic locking device, comprising:

a bolt;

a housing configured to translate between a first position and a second position, said housing comprising a display portion and said housing covering, when in said first position, a key hole;

an accelerometer configured to detect an acceleration associated with displacement of the housing display between the first position and the second position; and a processor communicably coupled to receive an input from the accelerometer, determine whether the acceleration indicates displacement of the housing to expose a physical key cylinder housing in connection with use of a key in the key hole of the locking device, and configured to initiate transmission of a message to a device remote from the locking device by a transceiver communicably coupled to the processor when the processor determines that the acceleration indicates displacement of the housing in connection with use of the key in the key hole of the locking device.

10. The electronic locking device of claim 9, wherein the housing includes a display.

* * * * *